US005951358A

United States Patent [19]

Hilko et al.

[11] Patent Number: 5,951,358

[45] Date of Patent: Sep. 14, 1999

[54] TOY VEHICLE WITH AN INTERNAL BOOK

[75] Inventors: Steve Hilko, Dubuque; Mark Reyner, Oelwein, both of Iowa

[73] Assignee: The Ertl Company, Dyersville, Iowa

[21] Appl. No.: 09/018,454

[22] Filed: Feb. 4, 1998

[51] Int. Cl.[6] ..... A63H 33/38; B42D 3/08; B42F 21/00

[52] U.S. Cl. ..... 446/147; 446/73; 446/76; 446/78; 281/29; 283/38; 206/424; 220/4.24; D19/28

[58] Field of Search ..... 446/71, 73, 76, 446/78, 147, 487; 281/22, 35, 38, 4, 19.1, 20; 283/38, 63.1, 34; 206/424, 457; 220/4.23, 4.24; D19/28

[56] References Cited

U.S. PATENT DOCUMENTS

| | | | |
|---|---|---|---|
| D. 327,713 | 7/1992 | Thomson et al. . | |
| 533,811 | 2/1895 | Hon | 283/38 |
| 3,629,033 | 12/1971 | Carter et al. | 156/204 |
| 3,831,832 | 8/1974 | Gray . | |
| 4,036,417 | 7/1977 | Traphagan | 281/19.1 |
| 4,098,443 | 7/1978 | Coen et al. | 281/19.1 |
| 4,597,743 | 7/1986 | Becker et al. . | |
| 4,819,963 | 4/1989 | Wolski . | |
| 4,828,289 | 5/1989 | Korner . | |
| 4,850,924 | 7/1989 | Becker et al. . | |
| 4,865,574 | 9/1989 | Kobayashi . | |
| 4,970,984 | 11/1990 | Vazquez | 116/234 |
| 5,056,663 | 10/1991 | Ostrowski | 206/424 |
| 5,059,149 | 10/1991 | Stone | 446/73 |
| 5,213,504 | 5/1993 | Lee et al. . | |
| 5,370,419 | 12/1994 | Takayama | 281/31 |
| 5,632,375 | 5/1997 | Matikow . | |

OTHER PUBLICATIONS

Muffsinger, Happy the Hippo Book Photos and Photocopy of Package, 1996, Victoria House Publishing Ltd, Bath, England.

*Primary Examiner*—Robert A. Hafer
*Assistant Examiner*—Laura Fossum
*Attorney, Agent, or Firm*—Lathrop & Clark, LLP

[57] ABSTRACT

A combination toy vehicle and book having a toy vehicle with an inner rigid frame and an outer flexible three-dimensional shell that alleviates possible pinch points when the vehicle is opened to reveal the book and the internal book has page tabs that extend out of an opening in the toy vehicle to assist opening toy vehicle when desired.

7 Claims, 4 Drawing Sheets

TOY VEHICLE WITH AN INTERNAL BOOK

BACKGROUND OF THE INVENTION

This invention relates generally to toy vehicles having an internal book and particularly to a toy vehicle having internal book pages that are visible through an opening in the toy vehicle to encourage reading and aid children in opening the vehicle to reveal the book. The toy vehicle structure includes an internal rigid frame that strengthens and stabilizes the vehicle during use and a flexible outer shell to enhance appearance to young children and for alleviating potential pinch points when the vehicle is opened to reveal the book.

It has been known to provide children's books with wheels for rolling the book along a play surface as if it were a toy vehicle. For example, U.S. Pat. No. 4,597,743 discloses such a book wherein wheels are rotatably mounted on the book's covers. The book covers also include appropriate depictions of vehicles to provide some semblance of a toy vehicle. Such a book, however, is relatively unstable because of its vertical orientation and the tendency for the pages open while the book is being rolled by the child. To overcome this latter disadvantage, the book is provided with a locking apparatus having a strap 40 and a snap 44 that may be difficult for a young child to manipulate. Even with such a locking apparatus the book has limited play value as a toy vehicle.

Another combination book and wheel toy is disclosed in U.S. Pat. No. 4,850,924 which overcomes the instability problems of the '743 patent book by orienting the book in a horizontal plane and rotatably mounting wheels in a back (or bottom) cover of the book. Although more stable and less likely to open accidentally, the '924 book still has limited play value due to its low-profile and lack of resemblance to a toy vehicle. Further, the connection of the wheel axles to the back cover may have a tendency to destroy the back cover of the book when used as a toy vehicle.

U.S. Pat. No. 5,213,504 discloses a coloring toy which resembles a toy vehicle and has a first cover portion and a second cover portion that define a pocket to receive art supplies in a closed position. This toy vehicle can have rotatable wheels mounted thereon so that the structure may be used as a toy truck. As can be seen in FIG. 3 of the '504 patent, when the truck is in the open position, both of the rigid truck back portions can come into contact with one another to define a pinch point that could hurt a young child who opens the truck. Further, there is no disclosure in this patent for using a book within the truck or any means for encouraging a child to open the toy to get at its contents.

U.S. Pat. No. 4,819,963 discloses a combination book and sculpture including first and second halves joined together by a hinge strip 52 such as a flexible web that may be an extension of one or more sheets from an internal book. The pages of the book are shaped to substantially the same contours as the sculpture so that when the sculpture is in the closed position, only the edges of the book pages are visible. There is no disclosure in the '963 patent of a toy vehicle with an internal book. Further, the cost for producing a combination book and sculpture as disclosed in the '963 patent must include the cost of shaping the edges of the pages to conform precisely to the shape of the sculpture and is unlikely to provide enough strength to use the sculpture as a toy vehicle. Further, the flexible web that serves as a book binding also must be strong enough to act as a hinge for the two halves of the sculpture and is unlikely to provide enough strength to use the sculpture as a toy vehicle. The pages of the book are held in close relation by means of a closure 62 that may be a hook and loop material or a snap on each book page. Having a closure on each page adds to the cost of producing such a book.

Thus, it is desirable to have a combination toy vehicle and book that acts as a true toy vehicle and which minimizes pinch points when the vehicle is opened to reveal a book inside. Further, it is desirable to have a toy vehicle with a book inside that is at least partially exposed to encourage use by a young child and to provide tabs which aid in opening the toy vehicle to reveal the internal book.

SUMMARY OF THE INVENTION

A toy vehicle with an internal book in accordance with the present invention overcomes the disadvantages of prior books combined with wheels or other toys because the present invention is stable in its upright configuration, it stays closed until book reading is desired, it eliminates a possible pinch point when the vehicle is opened, a small child will be enticed to read the book because pages are visible at the bottom of the toy vehicle even when the vehicle is closed, and tabs on the pages help a small child turn pages and open the vehicle to reveal the book.

In accordance with present invention there is provided a combination toy vehicle and book having: a first vehicle portion and second vehicle portion joined to the first vehicle portion by a hinge, the first vehicle portion and the second vehicle portion define a pocket when the toy vehicle is in a closed position; the book is disposed in the pocket and has a number pages with tabs, each of which is fixed a corresponding book page and extends out of the pocket to aid a child when opening the toy vehicle and when turning book pages.

The toy vehicle preferably includes an inner rigid frame and an outer flexible shell, whereby the inner rigid frame provides structural rigidity for the toy vehicle when it is being rolled along a play surface and the outer flexible shell is molded in a three-dimensional shape to eliminate any pinch points that would otherwise result from the two-piece inner rigid frame. The toy vehicle wheels are preferably mounted to the toy vehicle rigid frame so that they are freely rotatable and provide a wide wheel base to provide optimal play value.

DETAILED DESCRIPTION OF THE DRAWINGS

Figure 1:
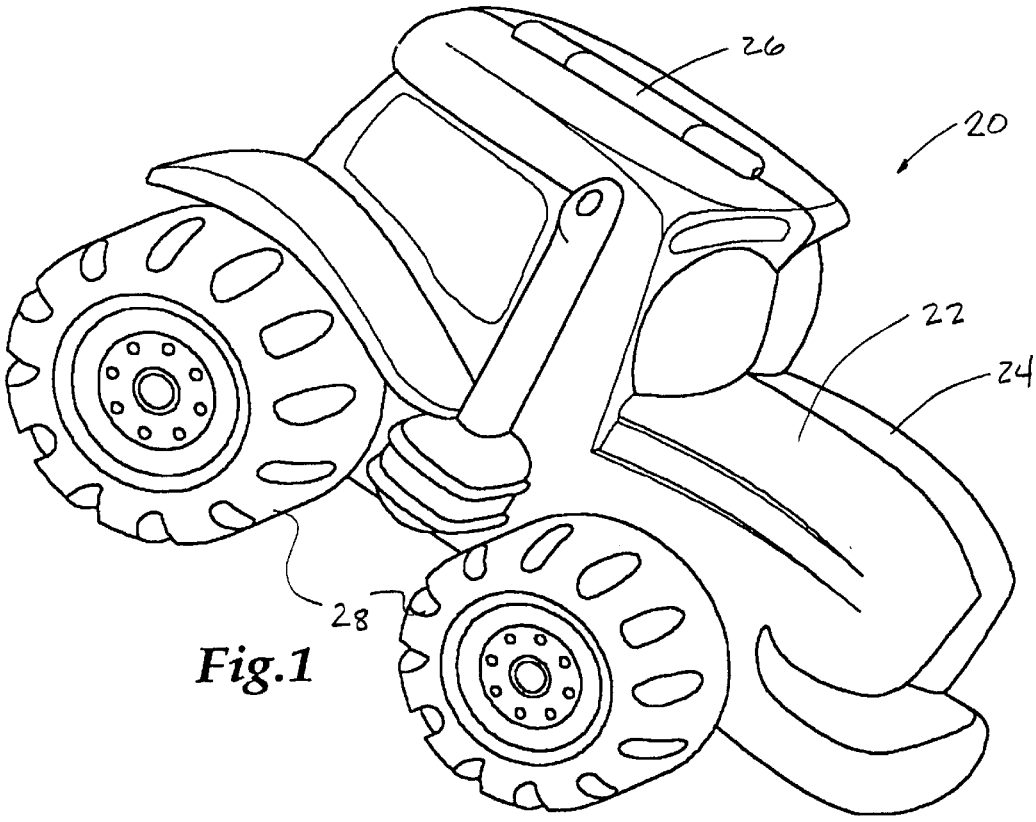
FIG. 1 is a perspective view of a toy vehicle with an internal book in accordance with the present invention.

In the following detailed description of drawings, the same reference numerals will be used to identify the same or similar elements in each of the figures. Illustrated generally in FIG. 1, is a toy vehicle 20 in accordance with the present invention having a first vehicle portion 22, a second vehicle portion 24, a hinge 26 joining the first vehicle portion 22 to the second vehicle portion 24, and a first pair of wheels 28. The toy vehicle 20 is preferably in the form of a stylized vehicle such as a tractor (as illustrated) to enhance the play value for young children. Further, the vehicle 20 is proportioned to be substantially wider than a book to make the vehicle 20 stable as it rolls along a play surface.

Figure 2:
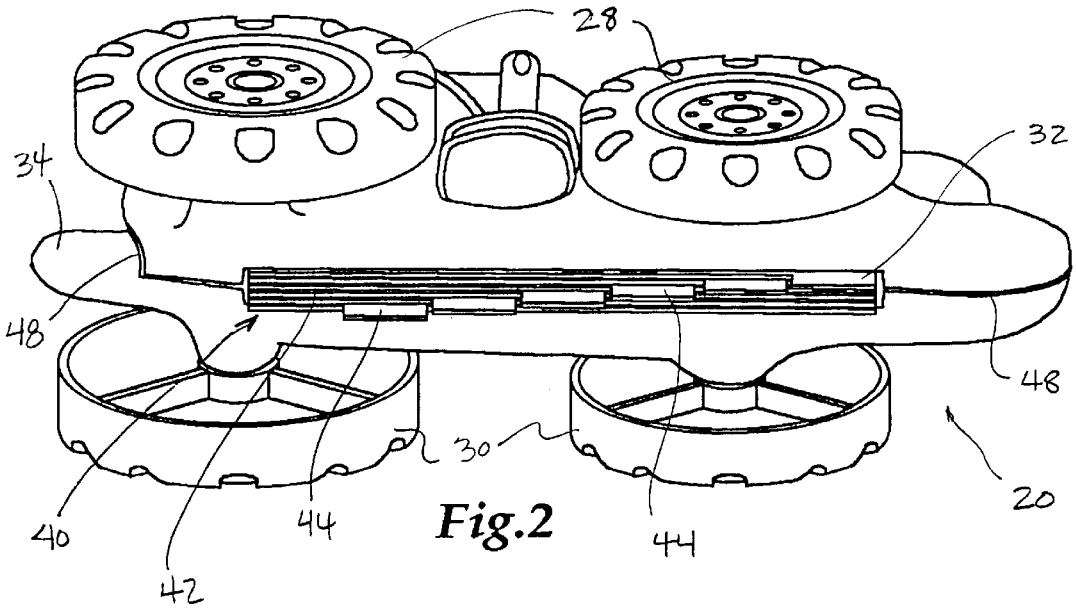
FIG. 2 is a perspective view of the bottom side of a toy vehicle in accordance with the present invention having a bottom opening through which book pages are visible and page tabs extend.

FIG. 2 illustrates the underside of the toy vehicle 20 to reveal a second pair of wheels 30 on the second vehicle portion 24, a bottom vehicle opening 32, and a rear trailer hitch 34. Visible in the bottom vehicle opening 32 is a book 40 having a plurality of pages 42, some or all of which have downwardly extending tabs 44 which preferably extend completely through the bottom vehicle opening 32. As can be seen in FIG. 2, the first vehicle portion 22 and the second vehicle portion 24 meet at an interface 48 which divides the vehicle 20 in nearly identical halves, with the exception of the rear trailer hitch 34 which for the convenience of manufacturing, is molded integrally with the second vehicle portion 24.

Figure 3:
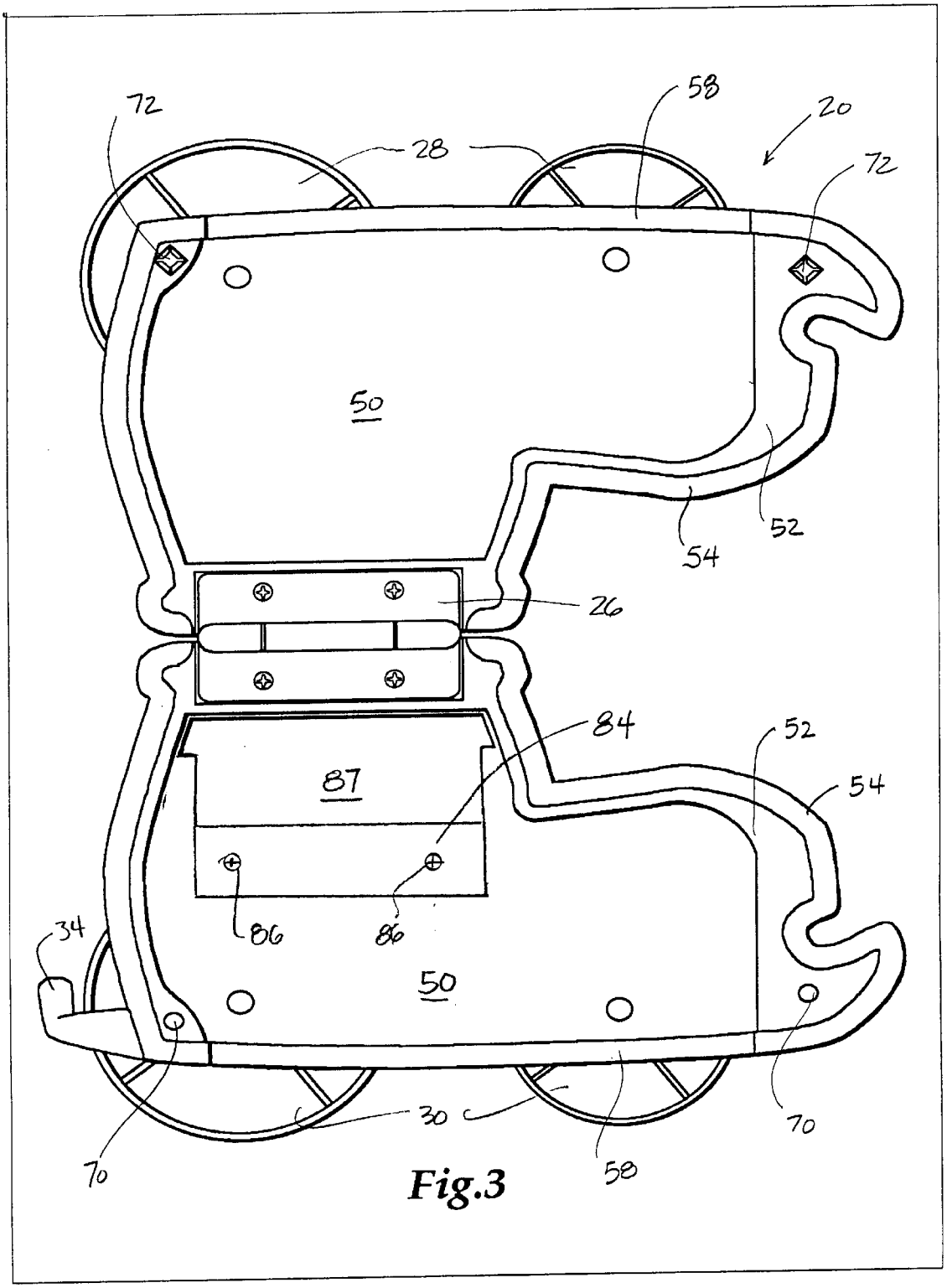
FIG. 3 is a view of the toy vehicle in an opened position to reveal an inner pocket wherein a book can be inserted.
Figure 8:
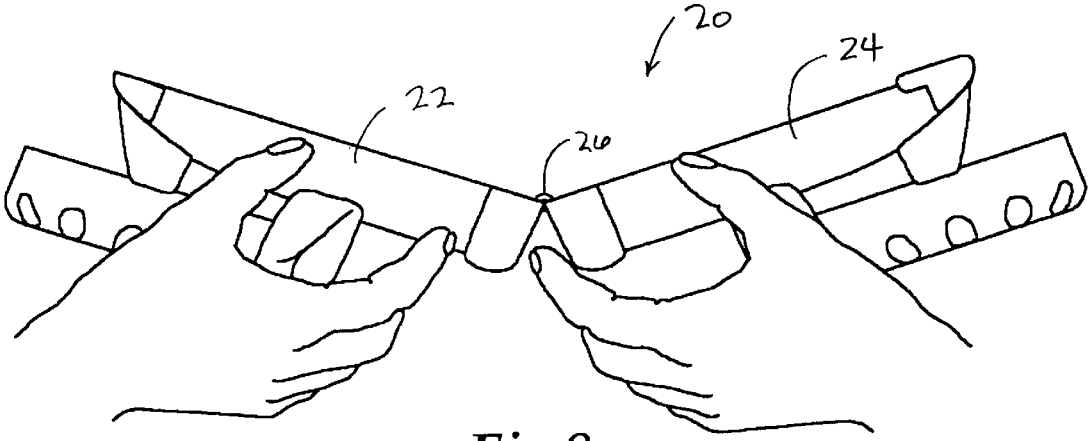
FIG. 8 is an illustration of the toy vehicle being opened.
Figure 9:
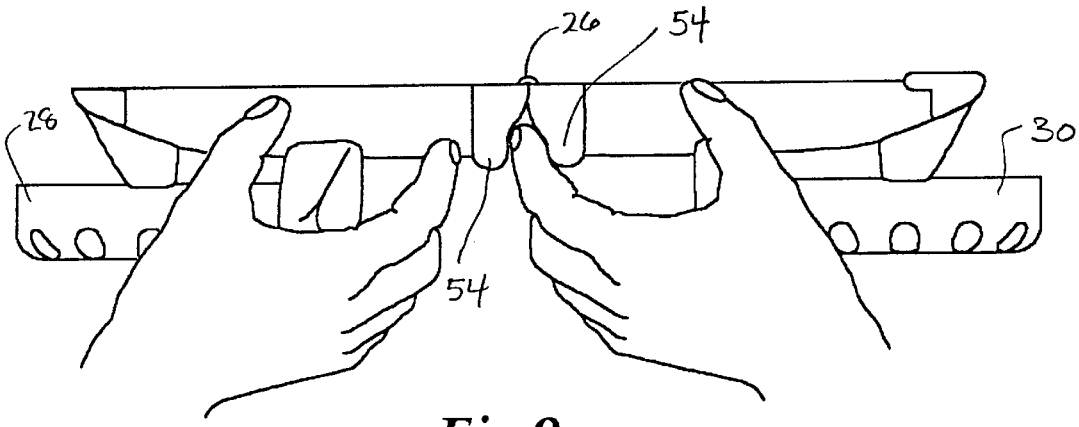
FIG. 9 is an illustration of a pinch point that is alleviated by the outer flexible vehicle shell.

Illustrated in FIG. 3 is the toy vehicle 20 in an opened position to reveal an internal pocket 50 defined by recesses in the first vehicle portion 22 and the second vehicle portion 24. The internal pocket 50 is illustrated as roughly conforming to the outer profile shape of the toy vehicle 20, but it could have any shape, as desired. Both the first vehicle portion 22 and the second vehicle portion 24 include an inner rigid frame 52 and an outer flexible shell 54. The inner rigid frame 52 is preferably made of acrylonitrile-butadiene-styrene and the outer flexible shell 54 is preferably made of polyvinyl chloride which is molded into the desired shape of the toy vehicle 20. The inner rigid frame 52 is preferably relatively flat as compared to the outer flexible shell 54 to alleviate pinch points that may develop when the toy vehicle 20 is opened. With the flexible outer shells 54 of the first vehicle portion 22 and the second vehicle portion 24 coming into a contact in the open position (FIGS. 8 and 9), any pinch points that do develop around the hinge 26 will be further alleviated by a gentle squeeze of the flexible material forming the outer shell 54. Further, the inner rigid frame 52 is preferably in the shape of the profile of the toy vehicle 20 to provide maximum rigidity and stability for the vehicle 20 when being rolled along a play surface (not illustrated).

The inner rigid frame 52 preferably has around its perimeter, a flange 58. A corresponding lip 60 on the outer flexible shell 54 can be wrapped around the flange 58 to engage the outer flexible shell 54 to the inner rigid frame 52 without the need for other fasteners. However, to prevent inadvertent or intentional disassembly of the toy 20, it is preferable to apply an adhesive to the interface between the flange 58 and the lip 60.

The inner rigid frame 52 of the first vehicle portion 22 and the second vehicle portion 24 are joined by the hinge 26, as illustrated. By connecting the rigid frames 52 of both vehicle portions, a stronger connection and a more reliable hinge action are attainable.

Figures 4, 5, 6, 7:
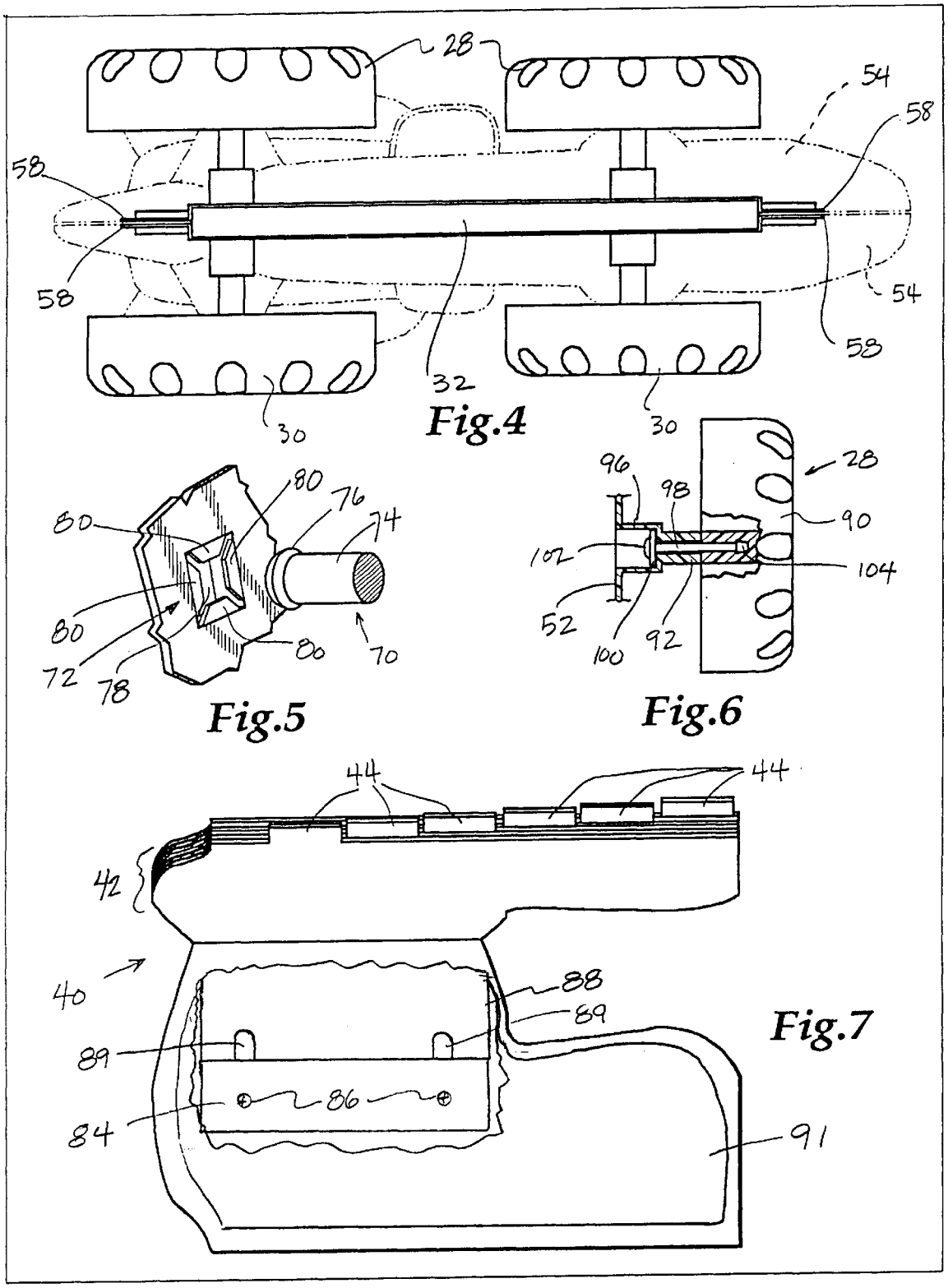
FIG. 4 is a bottom view of the toy vehicle illustrating the rigid frame with a three-dimensional flexible shell illustrated in phantom lines.
FIG. 5 is a perspective view of a snap connector for maintaining the vehicle in a closed position.
FIG. 6 is a partial cross-sectional view illustrating the connection detail of a wheel to the rigid frame of the toy vehicle.
FIG. 7 is an illustration of a back cover of a book clamped to the rigid frame of a toy vehicle.

A closure means is provided to keep the toy vehicle 20 in the closed position unless and until the book 40 is to be read. The closure means preferably includes a pair of male snap elements 70 and a pair of female snap elements 72. As illustrated is in FIG. 5, each male snap element 70 includes a post 74 with an enlarged head 76. Each female snap element 72 includes a recess 78 having a number of inwardly extending resilient tabs 78. The closure means operates automatically when the toy vehicle 20 is closed to bring the male snap elements 70 into engagement with the female snap elements 72. When this happens, the enlarged head 76 will bend the resilient tabs 80 until the head 76 passes the resilient tabs 80 into the recess 78. The resilient tabs 80 then return to their normal configuration as illustrated in FIG. 5 to retain the male snap element 70 in the recess 76. To release the closure means, the first vehicle portion 22 and second vehicle portion 24 must be pulled apart either by pulling directly on the vehicle opening 32, or by spreading the tabs 44 on the book pages 42 to reverse the closure process of the snaps.

Referring to FIG. 3, there is depicted a book clamp 84 which is secured to the second vehicle portion 24 by a pair of screws 86. The book clamp 84 is spaced apart from the hinge 26 and adjacent to a second recess 87, and may be formed integrally with or separate from the inner rigid frame 52. When formed integrally with the inner rigid frame 52, the clamp 84 can be either hinged or flexible enough to respond to tightening of the screws 86.

The book 40 as illustrated in FIG. 7, includes a back cover 88 that slides under the book clamp 84 and rests in the second recess 87. A pair of slots 89 accommodates the screws 86 so the screws can be in place when the book is installed for ease of manufacture. After the book cover 88 is under the clamp 84 and in the recess 87, the screws 86 can be tightened to bear down on the clamp and secure the book in place. The book cover 88 is shaped to match the second recess 87 and is smaller than the pages of the book. Additionally, the last page 91 of the book (FIG. 7) can be glued to the recess 50 in the second vehicle portion 24. Together, the clamp 84 and glued last page 91 secure the book within the toy vehicle recess 87.

As illustrated, the book 40 is roughly shaped to match the profile of the toy vehicle 20, but other shapes including more conventional book shapes can be used with the present invention. In the illustrated embodiment of the book 40, the pages 42 are made of a relatively rigid paper board material, but other paper weights or materials can be used. Further, the tabs 44 can be formed integrally with the book pages 42, particularly when the pages 42 are made of paper board. Otherwise, the tabs 44 can be made of any material or be secured to the book pages 42 in any conventional manner. Preferably however, the book pages 42 and tabs 44 are made of a relatively heavy material such as paper board so that the tabs can be pulled hard to open the toy vehicle 20 over the resistence of the snaps and reveal the book 40 disposed therein. Further, an extended temporary tab (not illustrated) can be secured to a page of the book or its cover or to the vehicle itself with a releasable glue or tape so that a potential purchaser of the book can pull open the book while the book is in a display package on a store shelf With this arrangement, the vehicle 20 is secured to the package by tying the vehicle second half 24 to the package and leaving the vehicle first half 22 free to be opened by a pull on the temporary tab.

The wheels 28 are preferably joined to the toy vehicle 20 in a manner depicted in FIG. 6 which provides a wheel base that is substantially wider than the width of the book 40 to provide stability and optimum play value. The illustrated wheel 28 is of unitary molded plastic construction having an outer surface 90 and a hollow stem 92. A corresponding outwardly extending hub 96 is formed integrally with the inner rigid frame 52. The wheel stem 92 and frame hub 96 are secured to one another using a pin 98 that has a washer 100 to prevent a pin head 102 from pulling out of the hub 96, and an enlarged base 104 that is press-fit into the hollow stem 92 to permit relative rotation between the wheel 28 and toy vehicle 20. By forming the hub 96 with the rigid frame 52, there is more reliable load transfer and, thus, better stability as the toy vehicle 20 when being rolled on a play surface.

The foregoing detailed description was provided for clearness of understanding only and no unnecessary limitations therefrom to be read into the following claims.

We claim:

1. A combination toy vehicle and book comprising:

a first vehicle portion and second vehicle portion hinged to the first vehicle portion to define an internal pocket with an opening when the first vehicle portion and second vehicle portion are in a closed position;

the first vehicle portion and the second vehicle portion each include an inner rigid frame and an outer flexible surface whereby the outer flexible surface alleviates pinch points when the first vehicle portion and the second vehicle portion are in an opened position;

a book disposed in the internal pocket, having a plurality of pages and a plurality of tabs each joined to a separate page and extending out of the opening defined by the first vehicle portion and the second vehicle portion; and a plurality of wheels rotatably mounted on the inner rigid frame to provide a wheel base that is substantially wider than the thickness of the book.

2. The combination toy vehicle and book of claim 1, wherein the book is fixed to the second vehicle portion by a book clamp fastened to the inner rigid frame of the second vehicle portion.

3. The combination toy vehicle and book of claim 1, wherein at least two of the page tabs are adapted to be spread apart to open the first vehicle portion and the second vehicle portion and reveal the book.

4. A toy vehicle with an internal books comprising:

a first vehicle portion and a second vehicle portion joined to the first vehicle portion by a hinge, the first portion and the second portion defining a pocket when the toy vehicle is in a closed position;

a book disposed in the pocket, and having a plurality of pages and a cover fixed to the second vehicle portion;

a plurality of tabs each of which is fixed to a separate page of the book and extends out of the pocket to be manipulated when the toy vehicle is in the closed position; and a plurality of wheels rotatably joined to rigid frames in the first vehicle portion and the second vehicle portion to provide a wheel base that is substantially wider than the thickness of the book.

5. The toy vehicle with an internal book of claim 4, wherein the first vehicle portion and the second vehicle portion define an opening when in the closed position through which the tabs extend.

6. The toy vehicle with an internal book of claim 4, wherein the first vehicle portion and the second vehicle portion each comprise:

an inner rigid frame; and an outer flexible shell.

7. The toy vehicle with an internal book of claim 4, wherein the first vehicle portion and the second vehicle portion each comprise:

an inner rigid frame; and an outer flexible shell, wherein the inner rigid frames are hinged to one another and the outer flexible shells are in contact with one another when the first vehicle portion and the second vehicle portion are in an opened position.

* * * * *